United States Patent [19]

Sasaki et al.

[11] 4,244,171

[45] Jan. 13, 1981

[54] BULKABLE FILAMENTARY YARN

[75] Inventors: Yoshiyuki Sasaki, Takatsuki; Shiro Kumakawa; Katsuyuki Kasaoka, both of Ibaraki; all of Japan

[73] Assignee: Teijin Limited, Osaka, Japan

[21] Appl. No.: 39,476

[22] Filed: May 16, 1979

[30] Foreign Application Priority Data

May 17, 1978 [JP] Japan ..... 53-58658
May 24, 1978 [JP] Japan ..... 53-60901
May 24, 1978 [JP] Japan ..... 53-60902

[51] Int. Cl.[3] ..... D02G 3/44; D02G 3/04
[52] U.S. Cl. ..... 57/208; 57/244
[58] Field of Search ..... 57/206, 208, 244, 246, 57/289, 310, 350, 908; 78/252, 271

[56] References Cited

U.S. PATENT DOCUMENTS 3,199,281 8/1965 Maerov et al. ..... 57/208 X
3,948,033 4/1976 Henstock et al. ..... 57/208
3,972,174 8/1976 London et al. ..... 57/208
4,069,565 1/1978 Negishi et al. ..... 57/208 X
4,152,886 5/1979 Nelson ..... 57/350 X
4,167,847 9/1979 Arai ..... 57/244

*Primary Examiner*—Donald Watkins
*Attorney, Agent, or Firm*—Sughrue, Rothwell, Mion, Zinn & Macpeak

[57] ABSTRACT

Disclosed is a novel bulkable filamentary yarn of a flat yarn-like smooth appearance, said bulkable filamentary yarn is composed essentially of a bulkable portion and an interlaced portion existing alternately along the yarn length. Upon scouring, for example, said yarn develops its latent bulkiness similar to the fullness of silk, thus a silk-like appearance as well as a silk-like hand are provided in a fabric. The yarn itself can be obtained by heat-shrinking arc-like loops protruding on the yarn surface into a straightened state parallel to the yarn while the yarn is being tensioned along its length.

6 Claims, 18 Drawing Figures

BULKABLE FILAMENTARY YARN

BACKGROUND OF THE INVENTION (1) Field of the Invention

The present invention relates to a bulkable yarn for weaving or knitting into fabrics which are really natural silk-like in general appearance, luster, hand liveliness and hue, and a process and an apparatus for the preparation of the same.

The term "bulkable filamentary yarn", as used herein, comprehends a thermoplastic multi-filamentary yarn having mixed differential boil-off shrinkage portions at considerably short intervals along the yarn length, said portions being composed of the filaments differing in shrinkage among the filaments as well as within each of the filaments, and developes its latent bulkiness to show silk-like hand and fullness when heat-relaxed. Although the word "fullness" means bulky state in general it is characteristic of silk, and distinguished, for example, from a bulky state of crimped yarn.

(2) Description of the Prior Art

As disclosed in the specification of British Pat. No. 1,510,337 or Japanese Patent Publication No. 47550/1972 and No. 18535/1976, it is well known to produce a textured yarn with crimps and length-difference induced among the constituent filaments by contacting a thermoplastic filamentary yarn instantaneously to a heated body (roll) of dry heat type under a tension below the thermal shrinkage stress of the yarn (more concretely under substantially tension free state) wherein a part of the constituent filaments shrinks intermittently and, accordingly, an another part of the same is made puckered to form loops and slack protrusions.

Thus obtained textured yarn bears on its surface a large number of loops and the like, and as the result, although the yarn presents silk-like hand and tactility to some extent, it has left many problems unsolved in view of a commercial production as follows:

(i) Since the filamentary yarn undergoes an irregular thermal treatment in transverse and lengthwise direction, splashed pattern streaks arise on the surface of a woven or knitted fabric made up of such yarn. This is due to an unstable heat-treating process because the filamentary yarn is subjected to contact heat-treatment in a state substantially free from tensioning which state, in turn, prevents smooth running of the yarn over the heated body.

In order to avoid such streaks, one can imagine in his mind that the partial, predetermined filaments shall undergo the heat-treatment selectively at a constant ratio. But, the limitation of "instantaneous" with regard to a treatment time makes it impossible, for example, to heat always one-half of all the filaments and actually makes a constant variance of the numbers of the filaments to be heated. Further a processing speed of the above method becomes limitative of its own accord.

(ii) As the result of shrinking filamentary groups partially, loops and the like are formed on the surface of the yarn. The existence of such protrusions deteriorates the handling and running property of the yarn, and accordingly, the weaving or knitting efficiency (performance) especially. In addition, the surface appearance of fabrics obtained is spoiled its commercial value.

For this reason, such process has also been proposed to re-heat the loop yarn above mentioned to diminish said loops in order to improve the handling and running property. In this process, however, the difference of boil-off shrinkage between the more shrinkable portions and the less, shrinkable portions originally induced in the form of the loop yarn is easily reduced to a quite limited range.

Therefore, such hand and tactility originally possessed by the loop yarn can never be expected to develope again.

(iii) Since the textured (loop) yarn is composed of partially shrunken filaments under an extremely lower tension, it possesses flow portions scattered therein. Due to the existence of these portions, the yarn is stretched with irregularity during weaving or knitting operations so that tight spots arise inevitably and fabrics obtained tend not to be restored to the original state after it is deformed.

(iv) Although the textured yarn possesses both the more shrinkable components and the less shrinkable components, these components exist in separate state (not commingled state), which state is mainly attributed to the reason that the process itself adopts anyway one-side heating of the starting yarn under an instantaneous period of time. Accordingly, the loop or textured yarn obtained, when heat-relaxed, for example, at a dyeing stage, only exhibits a puckered form as a whole and therefore, silk-like effects in the term of "moderate fullness" as realized by the mixed, differential shrinkage characteristics is lowered.

As mentioned above, conventional silk-like yarn of thermoplastic material with the differential shrinkage characteristics induced therein has always offered serious problems such as dyeing speck, lower restoring power and deterioration of weaving efficiency, and even at present silk-like aesthetics inherently possessed by such yarns have not been manifested sufficiently in fabrics.

SUMMARY OF THE INVENTION

It is therefore the primary object of the present invention to provide a novel bulkable filamentary yarn with an improved handling and running property for weaving and knitting into fabrics not only having a silk like appeal in hand, luster and liveliness, but being free from dyeing speck and other problems.

During out intensive research for achieving these objects, the inventors confirmed that an extremely desirable latent-bulkiness character as well as an improved handling property can be imparted to a filamentary yarn of thermoplastic material when said yarn having intermittently interlaced portions (points) and arc-like loops between each adjacent pair of said interlaced portions are subjected to such heat-treatment to allow loops only to shrink freely parallel to the major portion of filaments. In this case, the loop yarn as specified above can be preferably obtained by subjecting the same to an interlacing treatment under a controlled overfeed ratio.

Thus, according to the present invention the primary object can be achieved by a provision of a novel bulkable filamentary yarn in which constituent filaments of substantially straight form are assembled each other, said yarn having interlaced portions of at least 20 per meter along the yarn length wherein a filamentary group between each adjacent pair of interlaced portions exhibits mixed, differential boil-off shrinkage characteristics both among the filaments and within each of the filaments, and K value, as defined by the following formula, of the yarn being no more than 1.0

$K = l_1/l_2$ wherein $l_1$ is the length of an interlaced portion and $l_2$ is the length of a non-interlaced portion hereinbefore defined.

The object of the present invention can be achieved by a provision of a method for the preparation of a bulkable filamentary yarn, which comprises heating a interlaced filamentary yarn of thermoplastic material having arc-like loops on the surface of the yarn under a controlled tension so as not to remove said arc-like loops while maintaining said tension to a level of at least 0.02 g/denier whereby subjecting the yarn as a whole to a heat-treatment under the strained state while causing, concurrently, said loops shrink freely in order to convert them into a straightened state.

Still, the object of the present invention can be achieved by a provision of an apparatus which comprises (a) a feed roll and a withdrawal roll operating at a lesser peripheral speed than that of said feed roll, (b) a fluid interlace jet and a heater for thermal treatment located in sequence between the feed roll and the withdrawal roll and (c) a plurality of guides located between the jet and the heater, which deflect the yarn path while pressing the yarn laterally, whereby the yarn is relaxed in the fluid turbulent zone and strained in the heat treating zone.

Further, the object of the present invention can be achieved by a provision of a compact apparatus which comprises (a) a feed roll, a heater and a stepped roll arranged in sequence on substantially straight line wherein the larger diameter portion of said stepped roll serves as a draw roll for an undrawn yarn coming from the feed roll via the heater, and also serves as a forwarding roll in turn for the drawn yarn in a direction opposite to the direction of the undrawn yarn, (b) a fluid interlace jet for receiving the fluid treating the drawn yarn and yarn deflecting guides in combination for introducing the fluid-treated yarn again at the entrance of the heater wherein the heat-relaxed yarn is withdrawn by the smaller diameter portion of the stepped roll.

DETAILED DESCRIPTION OF THE INVENTION

Figure 1:
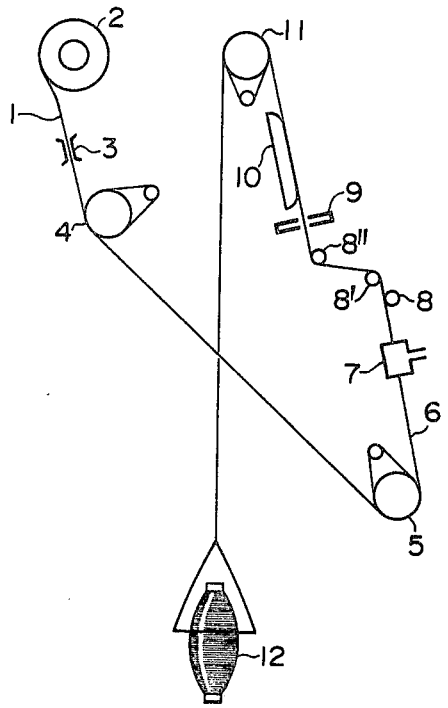
FIG. 1 is a diagrammatic representation of apparatus for carrying out the process.

Now, the description will begin with an explanation of an embodiment of the continuous process for manufacturing a bulkable filamentary yarn according to the invention with reference to FIG. 1.

This embodiment employs an undrawn or a partially drawn polyester yarn as the starting material to be treated. An undrawn yarn 1 unwound from a package 2 (in the form of a cheese) advances toward a feed roll 4 via a tension device 3, then passes around said feed roll 4 and a draw 5 sequentially. Between the feed roll 4 and the draw roll 5, the feed yarn 1 is drawn at a predetermined draw ratio. A drawn yarn 6 leaving the draw roll 5 is continuously introduced into a fluid-turbulency jet 7 where it is converted into an intermittently interlaced yarn with arc-like loops. Then the yarn is forwarded, being deflected from its yarn path, between and by guide 8, 8', 8'' for deflecting yarn path, and passed through a buffer 9. The yarn 6 leaving said buffer 9 is further subjected to heat-treatment on a heater 10 under a tension of at least 0.02 g/denier but not so great as to remove said loops by a stretching force. On the heater the arc-like loops are allowed to shrink freely to become parallel to a grand portion of the yarn. Thus heat-treated yarn is then passed around a withdrawal (delivery) roll 11 from which it is fed to a winding device 12.

In the above, the delivery rolls 11 is adjusted to be driven at a peripheral speed smaller than that of the draw roll 5. Thus the drawn yarn 6 can be interlaced at a constant overfeed ratio to form arc-like loops thereupon. Although three series of guides 8, 8', 8'' are shown in Fig. this is not limitative in the invention, and two series of guides 8', 8'' may be adopted. These guides are useful for making the yarn tension at the fluid treating zone independent from that of the heat-treating zone, although the yarn is apparently in overfed state between the draw roll 5 and the delivery roll 11. Namely, by the presence of the guides the yarn 6 is maintained under an overfed state in the fluid treating zone while under a tensioned (strained) state in the heat-treating zone. Further, these guides allow the yarn 6 to procede while imparting the contact pressure to the yarn 6 by deflecting it, the yarn 6 never stick-slips on the heater 10 and accordingly, a uniform heating of the yarn 6 is effected. Of course, an intermediate roll may be used in stead of said guides if the installation cost and the ease-of-operation are neglected.

Additionally, the buffers shut out the influence of the fluid vented from the jet 7, upon the heater 10 where the yarn 6 may otherwise vibrate.

The above example, as will be understood, illustrates the preparation of a novel bulkable filamentary yarn of the invention using an undrawn yarn as the starting material wherein the drawn yarn 6 may ordinarily imparted a boil-off shrinkage of at most 15% and said yarn is further subjected to fluid and heat-treatment in sequence. In this regard, various modifications are taken, for example, a drawing operation may be carried out separately and an undrawn yarn previously prepared may be fed by the draw roll 5 to the subsequent treatments or a previously prepared interlaced yarn with arc-like loops may be heat-treated in the single stage.

A mechanism of the formation of a novel bulkable filamentary yarn according to the invention will be explained with reference to FIG. 2–FIG. 5.

Figure 2:
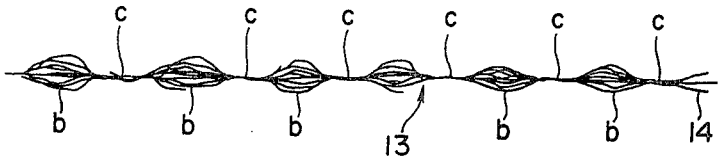
FIG. 2 is an enlarged side view of an interlaced yarn having arc-like loops intermittently along the yarn length.

In FIG. 2, 13 is a filamentary yarn composed of constituent filaments 14 in which b is a looped-out portion (or loop portion) where some of filaments form arc-like loops in various size and this portion exists between each adjacent pair of interlaced, portions designated in C. It is characteristic of this type of yarn that a major portion of the yarn is composed of the filaments except those looping out on the surface thereof, therefore, this major portion also serves as a tension bearing carrier. For this reason, when the above yarn is placed under a certain tensioned state (ordinarily less than 1.1 g/denier with a provision of such tension so as not to remove the arc-like loops), stress (tension) is concentrated in the major portion, in other word, said major portion bears all the stress and therefore, the arc-like loops are never diminished by stretching force. Accordingly, when the above yarn is heated under a tensioned state, arc-like loops bearing no tension are allowed to shrink freely due to higher heat-treatment efficiency and a boil-off shrinkage of the loop portion is lowered to the full extent. On the other hand, the major portion is heated under a tensioned state, therefore, less thermal treatment effect is obtained compared with that of the loop portion. As the result of differential treatment effect, the boil-off shrinkage difference between the looped-out portion and the major portion is further widened.

Figure 3:
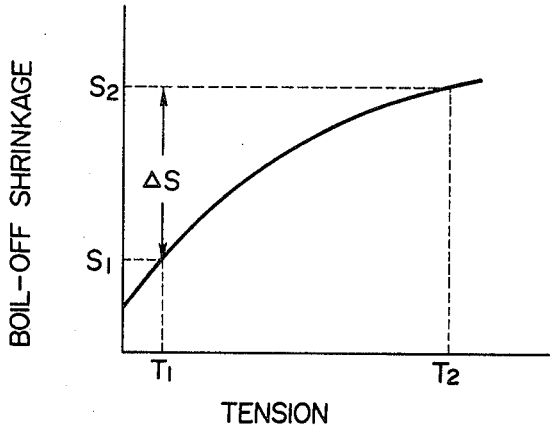
FIG. 3 is a graph explaining a relation between a tension exerted in an interlaced yarn being heated and a boil-off shrinkage of the heat-treated yarn.

FIG. 3 shows a relation between a tension and a boil-off shrinkage in the above case, where $T_1$ and $T_2$ both on the abscissa are tensions exerted in the loop portion and the grand portion, respectively, while $S_1$ and $S_2$ both on the ordinate are boil-off shrinkage induced by heat-treatment of the loop portion and the major portion, respectively. As will be clear from the graph, the lower tension during heat-treatment results in the higher heat-setting effect, as an amorphous phase of the fibre is relaxed and stabilized, which means to effect a considerable lowering of the boil-off shrinkage. More concretely, the grand portion heat-treated under the higher tension maintains substantially its original boil-off shrinkage $S_2$ while the loop portion heat-treated under substantially free from tension shows an extremely lowered boil-off shrinkage $S_1$, thus between these portion both existing in the same yarn, the maximum shrinkage difference is obtained.

Figure 4:
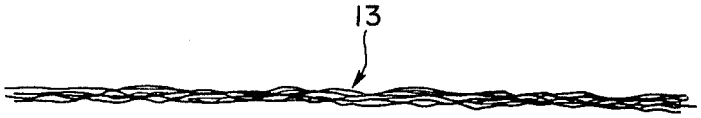
FIG. 4 is an enlarged side view of a bulkable filamentary yarn according to the present invention.
Figure 5:
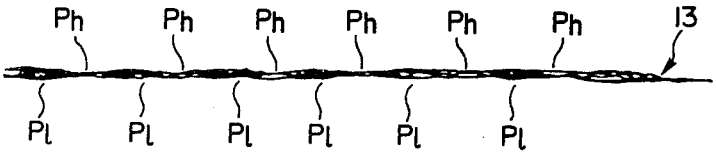
FIG. 5 is a greatly enlarged side view of a yarn in FIG. 4.

FIG. 4 shows a heat-treated yarn as mentioned above. Apparently this yarn displays a smooth surface, and there is not a bit of difference between this and an ordinary flat yarn. When said yarn is, however, profiled in the order of single filament, it has, along the yarn length, the low shrinkage portion Pl comprising shrunken loops and the high shrinkage portion Ph composed of substantially not shrunken filaments, as shown in FIG. 5.

By the term "the low shrinkage portion is meant the portion composed of differentially shrinkable filaments in randomly mixed state. Actually said portion is formed shrinking loops which has previously surrounded the grand portion and shows an appearance of a flat yarn.

Figure 6:
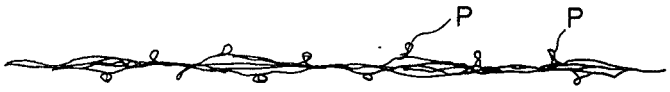
FIG. 6 is an enlarged side view of a heat-treated "TASLAN" ® yarn.

It is important to obtain such flat or smooth surface of the low shrinkage portion of the invention. For this purpose, individual filaments in the looped-out portion in FIG. 2 should form arc-like (half-arc state) loops or protrusion thereby smooth and efficient shrinkage of the loops becomes possible. In this regard, crunodal loop as is well known as inherent of "TASLAN ®" to those skilled in the art are substantially distinguished from said arc-like loops. The cronodal loops are formed by a filament doubling back upon itself, crossing itself and then proceding in substantially the original length. These kind of loops, even if heat-shrunken, never shrink in the straight form and result in little proturbences P on the surface of the yarn, as shown in FIG. 6. These proturbences P are not acceptable to the present invention because they not only form a kind of crimped portion but also display a hard and crisp hand when woven into a fabric.

The above proturbences may be avoided if the yarn is heated excessively. However filament distortion is inevitably left and displays its own glittering effect as frequency seen in fancy yarns. This glittering is far away from the mild luster possessed inherently by silk.

Figure 7:
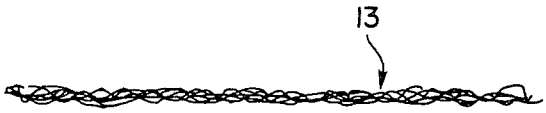
FIG. 7 is an enlarged side view of a silk-like yarn obtained by heat-relaxing a yarn in FIG. 4 (or 5).

On the contrary, FIG. 7 shows a state after the bulkable yarn in FIG. 4 (or 5) is relaxed in 100° C. water to develope its latent differential-shrinkage character wherein the major portion (core portion) existing through out the yarn length and the high shrinkage portion Ph (FIG. 5) intermittently existing along the yarn length differentially shrunken together to increase an interfilamentary space. Thus, the relaxed yarn has a heightened fullness, softness suppleness extremely similar to natural silk.

In the invention, the preparation of a bulkable filamentary yarn in FIG. 4 (or 5) is quite important as mentioned before.

Insufficient heat-shrinkage of the arch-like loops, leaving still slack filaments on the surface of the yarn produces a fancy fabric having the enhanced contour surface which is quite different from that of silk fabrics. Accordingly, arc-like loops should be sufficiently heat-relaxed to present a straightened state parallel to the grand portion of the yarn just as flat yarns. When a grey fabric made up of the above bulkable yarn is relaxed during scouring process, for example, it presents very smooth surface in addition to full tactility inherent of silk, and this effect can be obtained only when the mixed, differential shrinkage character of said yarn is developed to give full hand to the yarn. Therefore, care must be taken not to leave crunodal loops as well as slack filaments on the bulkable filamentary yarn shown in FIG. 4 (or 5).

Figure 8:
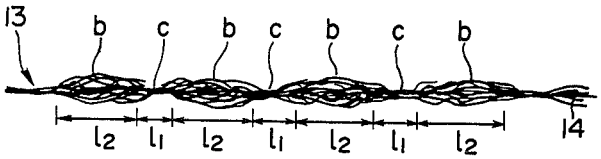
FIG. 8 is an enlarged side view of an intermittently bloomed yarn formed when a bulkable filamentary yarn in FIG. 4 or 5 is allowed to float on water.

One more critical requirement is left for a bulkable filamentary yarn according to the invention. The yarn should have K value of at most 1.0 expressed by the formula:

$K = l_1/l_2$ wherein $l_1$ is the length of an interlace portion and $l_2$ is the length of a non-interlaced portion. This limitation is further explained with reference to FIG. 8. The above bulkable yarn, when allowed to float on water contained in a vessel, exhibits an intermittently bloomed appearance as shown in FIG. 8 wherein $l_1$ is the length of an interlaced portion which corresponds substantially to the high shrinkage portion Ph in FIG. 5 and $l_2$ is the length of said bloomed portion which corresponds substantially to the low shrinkage portion Pl in FIG. 5, the latter is especially composed of differentially shrinkable filaments. The K value of at most 1.0 expressed by $l_1/l_2$ means that the bloomed portions governing mainly silk-like hand occupies at least 50% of the total length of the yarn. It is easily understood that the presence of interlaced portions is not meaningful for the development of silk-like hand although these are extremely useful for improving the handling and running property of the yarn. For this reason, K value of at most 1.0 becomes necessary to obtain such effect as if the interlace portions do not exist. Contrary, when the major part of the yarn is occupied by the interlace portions, one can not expect silk-like effects due to decrease of the bloomed portions. Therefore, at most 130 of interlaced portions per meter is an upper limit to the invention.

Ordinarily, the number of interlaced portions per meter is expressed by counting the tight portion in a bulkable yarn of 100 cm length with the naked eye, as shown in FIG. 8.

With regard to $l_1$ and $l_2$ from which K value is determined, each is expressed as an average length calculated from the total number of interlaced portions or tight portions existing in the bulkable yarn of 100 cm length, which is allowed to float on water as shown in FIG. 8. In detail, each length of the interlaced portions, for example, is first measured and a total sum in length is divided by the number of the interlaced portion to obtain $l_1$ as the average length, and this step also applies to the calculation for $l_2$.

Figure 9:
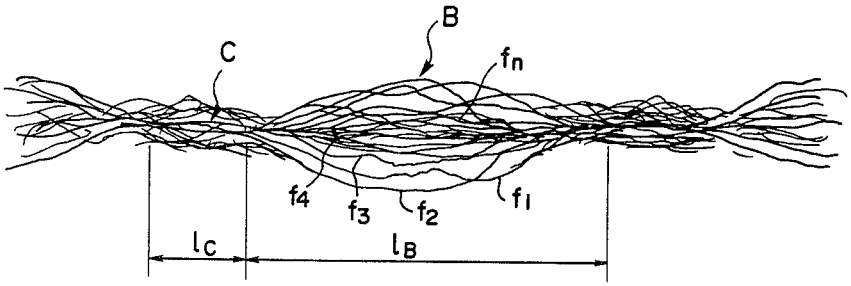
FIG. 9 is a greatly enlarged side view of a full-hand (bulkable) portion existing intermittently in a yarn in FIG. 7.

In a preferred embodiment of a bulkable filamentary yarn according to the present invention, it has a boil-off shrinkage of no more than 13%, and exhibits, upon heat-relaxation under a 195° C., dry heat atmosphere for a time of 5 minutes, following features in bulky (full-hand) portions B as shown in FIG. 9 which have been bloomed portions b in FIG. 8.

(a) the maximum filament-amplitude is no more than 25 mm.

(b) the maximum length-difference of the filaments is no more than 15%, and (c) filaments having the length difference of 3% to 12% occupies at least 15% of the total number of the constituent filaments.

Further explanation will be made on the above mentioned features with reference to FIG. 9, in addition to the limitation of boil-off shrinkage.

[Boil-off shrinkage at 100° C. water for 30 minutes]

The upper limit of 13% is determined from a view point of maintaining soft hand of the bulk-developed yarn shown in FIG. 7. Although boil-off shrinkage of more than 13% will, of course, gives a heightened interfilamentary spacement which is intended in the invention, the bulk-developed yarn tends to present a rather harsh hand due to excessive shrinkage of the yarn.

[Feature (a)]

In FIG. 9, a full hand portion B is composed of various filaments $f_1$, $f_2$, $f_3$ . . . $f_n$ differing in their amplitude i.e., the degree of looping out. Of these filaments, filament $f_1$ has the largest size, whose imaginative shortest line (distance) along the yarn axis is designated by $l_B$. For convenience, said $l_B$ (mm) is defined as "the maximum filament-amplitude" in the invention.

In case that said $l_B$ exceeds 25 mm, the quality especially, silk-like appearance of the bulk-developed yarn tend to be lowered and an unacceptable flash will appear in a fabric. Accordingly, $l_B$ is understood to controll an apparent size of the full-hand portions.

[Feature (b) . . . M.L.D.F.]

This is defined by the formula:

$$M.L.D.F. = \frac{l_m - l_B}{l_B} \times 100\ (\%)$$

where $l_m$ is an actual length of the filament $f_1$ and $l_B$ is the same as hereinbefore defined.

In case that a value of M.L.D.F. exceeds 15%, bulk-developed yarns tend to display slightly different hand and quality from these of silk.

[Feature (c)]

A factor important to full-hand portion B is an interfilament spacement which is governed by a distribution of the filament length-difference. A preferable silk-like effect can be enhanced in the presence of filaments having the filament length-difference of 3% to 12%, occupying at least 15% of the number of all the constituent filaments.

The filament length-difference in percent is determined in the same way as in explained about M.L.D.F.

By the way, the interfilament spacement formed by and in the presence of the filaments meeting the above two conditions is far less than that of so called "bulky yarn" such as false-twist crimped yarns. In this meaning, the term "full-hand portion" used in the invention is distinctly distinguished from bulky state of said crimped yarns. For reference, a bulkable yarn according to the present invention usually displays the bulk of 14 $cm^3/g$ to 20 $cm^3/g$ when it is heat-relaxed for the development of latent bulk due to the differential shrinkage.

The above bulk is determined as follows: A bulkable yarn is wound upon a wrap reel with a circumstantial length of 1.125 m by rotating it 320 turns. A hank removed from the reel is folded in the center and a 6 g of weight is suspended on an end of folded hank. In this state, the hank is heated at 195° C., dry heat for 5 minutes and then cooled to an ambient temperature. A volume (V) of certain amount of hank having its own weight W(g) is measured from which the bulk (B.I.) is calculated in accordance with the formula:

$$\text{Bulk } (cm^3/g) = V/W$$

Back to FIG. 1, various conditions for obtaining a bulkable filamentary yarn having the above mentioned specified properties are hereinafter described in detail. As a starting material, polyester, polyamide polypropylene yarns etc., are employed and these yarns entering jet 7 generally have a total denier of 15 to 125, preferably 30 to 75, a monofilament denier of no more than 1.7 and a boil-off shrinkage of 5% to 15%. Also the cross section of the filament may be round and non-round (preferably trilobal).

As mentioned before the above filamentary yarn is first treated in the jet 7 where arc-like loops are imparted to said yarn intermittently along the yarn length. For this purpose well known interlace nozzles disclosed in the specification of U.S. Pat. No. 2,985,995 are preferably used under a fluid pressure of 1 $Kg/cm^2$,G to 5 $Kg/cm^2$.G at a yarn overfeed ratio of 1% to 15% (preferably 1.5% to 6%) and yarn speed of at least 200 m/min. (preferably 500 m/min.).

Thus interlaced yarn (FIG. 2) should have interlaced portions of at least 20/meter (preferably 50) along the yarn length to obtain yarn coherency and also should be free from crunodal loops to the lesser extent, as explained before.

Next, the arch-like loop yarn is heated upon a heater 10 in the form of a contact type plate heater or a non-contact type pipe heater. In this step, it is necessary to shrink the arc-like loops only while a major portion of the interlaced yarn is maintained under a strain. Therefore a tension exerted in said yarn becomes critical. If the interlaced yarn is heated under a tension of less than the dry-heat shrinkage stress of said yarn, the yarn shrinks freely as a whole, resulting in the lesser differential shrinkage in the heated yarn. To avoid such vital disadvantage, the yarn entering the heater 10 should be tensioned to a level of at least 0.02 g/denier. The upper limit of the tension is such as not to remove the arc-like loops by stretch force.

The heater temperature and heating time must be adjusted to be enough for thorough shrinking of the loops, and generally the former being selected from a range of 130° C. to 250° L C., the latter from a range of 0.01 sec. to 0.1 sec.

Figure 10:
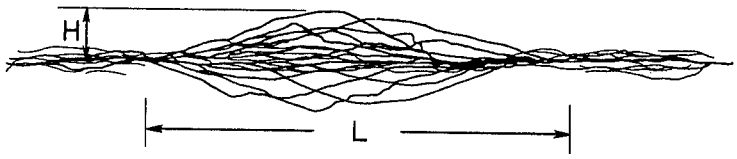
FIG. 10 is a greatly enlarged side view of an arc-like loop portion intermittently existing in a yarn in FIG. 2.

Additionally, the size and number of looped-out portion b are fairly important. In FIG. 10, the maximum apparent length L of said portion is preferably in the range of 1 mm to 25 mm and the maximum apparent height H is preferably in the range of 0.5 mm to 3.5 mm when measured under a tension of 0.05 g/denier. As to the number of said portions, at least 3 of them exist preferably per 1 cm of the interlaced yarn. Further it is preferable that at least 20% of all the number of the constituent filaments take part in the formation of the loops. Of these conditions, the maximum apparent length L is the most important factor. For example, a loop with L value less than 1 mm is easily converted into the crimped state similar to false-twist crimped yarn which is quite difference from fullness or full hand of silk.

Thus heat-treated yarn (FIG. 4 or 5) having almost the same appearance as of ordinary flat yarns is finally forwarded to a winding device.

As a winding device, a ring twister is shown in FIG. 2, but it is not intended to be limitative and other type of take up mean such as cheese winder may be used.

Figure 11:
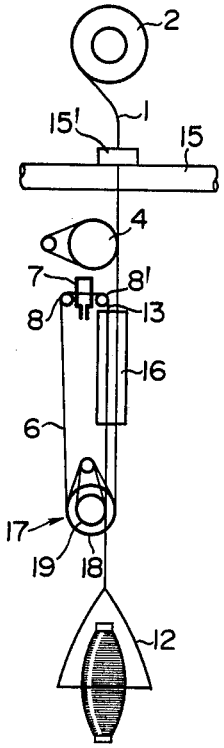
FIG. 11 is a diagrammatic representation of another embodiment of apparatus.

In FIG. 11, shown a compact apparatus for carrying out the process of the invention, which is a modified based upon a drawing machine as disclosed in the specification of U.S. Pat. No. 3,539,680. In the apparatus, an undrawn yarn 1 unwound from a package 2 is made pre-tensioned state between a pair of pre-tensioning rolls 15, 15' and a feed roll 4, then forwarded through a non-contact type heater to a stepped roll 17 upon the larger diameter portion 18 of which the forwarded yarn is passed around. Said larger diameter portion operates at a higher peripheral speed (usually 1.5–4 times) than that of the feed roll 4 whereby the yarn 1 is drawn between the feed roll 4 and the stepped roll 17 and concurrently heat-set by the heater 16 to adjust its boil-off shrinkage to a level of no more than 15%. The drawn yarn 6 is then forwarded toward a jet 7 in a direction opposite to the direction of the undrawn yarn 1. The yarn 6 is deflected via a guide 8 at a right angle, and during travelling to a guide 8' it is subjected to a fluid treatment by a jet 7 to give a interlaced yarn with arch-like loops. Although said jet 7 is located between guide 8 and 8' in this Fig., it may be placed before guide 8. This interlaced yarn changes its path toward the heater 16 and is introduced again into the same heater where the interlaced yarn is heated to shrink said loops parallely to the grand portion. The yarn leaving the heater 16 is passed around the smaller diameter portion 19 of the stepped roll 17 from which fed to take up mean 12.

As will be easily understood from the above, the features of this apparatus reside in that three kind of different yarn-treatments can be carried out by using substantially two rolls, namely, the feed roll 4 and the stepped roll 17. In the apparatus, a state of yarn overfeed can be realized between the larger diameter portion 18 and the smaller diameter portion 19 both constituting parts of the same roll i.e., stepped roll 17. As mentioned before, since an overfeed ratio of 1% to 15% is employed, the larger diameter portion 18 may have its diameter of as long as 1.01 times to 1.15 times of the lower distance portion 19. Actually, substantial overfeed state of the drawn yarn 6 is maintained between the portion 19 and the guide 8' for deflecting yarn path, by the same reason described in the case of FIG. 1. At the same time, the interlaced yarn is maintained under a strained state between the guide 8' and the portion 19 while said yarn is running through the heater 16 again.

Figure 12:
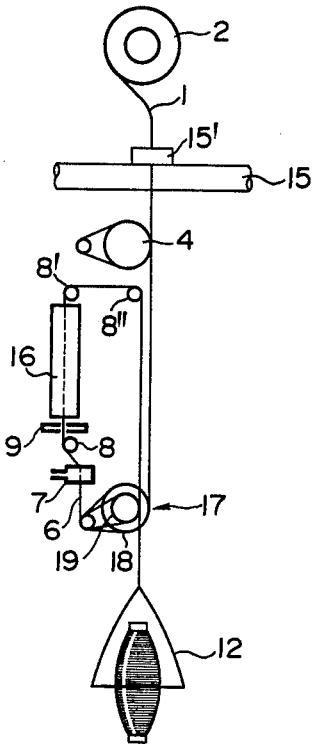
FIG. 12 is a diagrammatic representation of a modification of apparatus in FIG. 11.

An apparatus shown in FIG. 12 is essentially the same as in FIG. 11, except that the heater 16 is used for heating an interlaced yarn only. This apparatus is useful when a boil-off shrinkage of no more than 15% is attained without heating a drawn yarn.

As an advantage of these apparatus using a non-contact type heater which forms a heated atmosphere therein, it is emphasized that all of the loops existing randomly around the yarn are equally and uniformly shrunken. This effedct is rather difficult to obtain by a contact-type plate heater.

Now, the advantages of a bulkable filamentary yarn provided by the invention are summarized below.

(i) Splash pattern streaks are prevented when woven into a fabric since the bulkable filamentary yarn has undergone a regular heat-shrinking treatment along a transverse section and also the yarn length.

(ii) The handling and running property is highly improved compared with conventional textured yarns intended as silky material, since the bulkable filamentary yarn has not only almost the same appearance and smoothness as of flat yarns but interlaced portions along the yarn length.

(iii) In spite of the flat yarn appearance, the bulkable filamentary yarn comprises filaments substantially not shrunken throughout the yarn length, and said filaments mainly constituting major portion bear all the stress exerted in the bulkable yarn. Thus a problem of the tight spots (ends or wefts) is completely overcome.

In this point, the conventional texture yarn mentioned above comprises shrunken filaments as a major (core) component by which non-shrunken filaments loop out on the yarn surface.

(iv) In an intermediate yarn (an interlaced yarn with arch-like loops) randomly selected filaments due to whirling action of a turbulent fluid loop out on the yarn surface to form arch-like loops in different loop size. When such loops different in the size are shrunken, a mixed, differential shrinkage characteristics are imparted to the bulkable filamentary yarn.

A mode of developing the latent silky characteristics of the above bulkable yarn is taken in various form. For example, such yarn may be heat-relaxed while being forwarded in hot water or heat-relaxed in the form of hank while being immersed in hot water. Further, a grey fabric-made up of the yarns may be heat-relaxed during scouring and finishing stage. In case that fabric constituent yarn is polyester, then the fabric is referably subjected to its reduction in weight treatment by an alkaline solution, to enhance an interfilamentary spacement.

Generally speaking, it is preferable to weave or knitt the bulkable yarn into fabrics and then to subject said fabrics to heat-relaxing treatment in hot water to develope the latent silky characteristics of said yarn. In this case, interlaced portions of the yarn become loose by frictional contact, for example, with dents; harness and healds, and the said loosened interlaced portions contribute to increase of bulk.

The bulkable filamentary yarn may be used as the warp and/or the weft when woven into fabric.

In a preferred embodiment, said yarn is used both as the warp component and the weft component wherein the warp is twisted to no more than 300 turns/meter while the weft is twisted to at more than 300 turns/meter preferably more than 1000 turns/meter. In another embodiment, the yarn of the invention is preferably used as the warp component in the preparation of "de Chine" fabrics. In this case, the warp is twisted to at most 800 turns/meter while the weft of ordinary flat yarns or crimped yarns, preferably false-twist crimped yarns is twisted to at least 600 turns/meter.

These fabrics in the form of grey leaving the loom show only an appearance of fabrics made up of flat yarns, and to obtain silky like and/or "de Chine" fabric, said grey fabric is, as mentioned before, heat-relaxed in hot water, for example, at scouring, dyeing. As dyeing machines, winch type or circular type is preferably used. Upon, heat-relaxing, these fabrics are imparted silky appeal or mixed appeal of silky hand and "de Chine" hand according to combination of yarns for the weft and the wrap.

For further improvement of drapeability of these silky fabrics, they may be treated in the alkaline solution for the reduction in weight of said fabrics whereby contact-pressure between the warp and the weft is diminished enabling the warp to slip easily over or below the weft. As alkaline substances, natrium hydroxide, potassium hydroxide and natrium carbonate are used, in combination with alkaline-attack accelerating agents such as lauryl dimethyly benzyl ammonium chloride, cetyl dimethyl benzyl ammonium chloride.

The above treatment is carried out generally by dipping fabrics in an aqueous solution containing alkaline substances. The solution may be previously heated before or after the dipping operation. Generally the aqueous solution contains 20 g–400 g of alkaline substances per liter while a treating time is selected from a range of 30 minutes to 90 minutes. Important is a final reduction ratio of the fabrics and at least 10%, preferably 15% to 30% of reduction is recommended.

According to the invention, a bulkable yarn can be realized from a single end yarn of an uniform shrinkability to which a mixed differential shrinkage characteristics are imparted.

In the history of the textile industry, silk has been regarded as a royal fiber due to its luxurious luster and hand unmatched by other fibers. Although an extensive and continuing search has been made for a synthetic fiber with all of the desirable properties of silk, no one has obtained a satisfactory result from all the aspects of silk.

A woven fabric from a bulkable yarn of the invention exhibits an indistinguishable appearance as well as hand from silk, although said yarn is composed of synthetic material. In this meaning, it can be said that the present invention enables a synthetic fiber to achieve a novel commercial acceptability.

The following examples will serve to illustrate the invention, although they are not intended to be limitative.

EXAMPLE 1

Using an apparatus shown in FIG. 1, bulkable filamentary yarns are obtained under conditions in Table-I, and thereafter, said yarns are woven into a fabric having an appearance of a palace crepe under weaving conditions in Table-II. Further, the fabric obtained is dyed with use of DIANIX YELLOW-GR-E (C.I. DISPERSE YELLOW 60) as a dyestuff. The result of evaluation of the dyed fabric is shown in Table-III.

TABLE I (Conditions for preparing bulkable filamentary yarns)

| | | |
|---|---|---|
| (1) | Undrawn yarn 1 | Polyethylene terephthalate filaments with trilobal cross section, 143 de/36 fil. |
| (2) | Peripheral speed of a feed roll 4 | 170 m/min. |
| (3) | Peripheral speed of a draw roll 5 | 500 m/min. |
| (4) | Draw ratio | 2,933 |
| (5) | Boil-off shrinkage of a drawn yarn 6 | 6.7% |
| (6) | Peripheral speed of a delivery roll 11 | 465 m/min. |
| (7) | Fluid jet 7 | Same type as shown in FIG. 3 of U.S. Pat. No. 2,985,995, pressure 1 Kg/cm$^2$ . G |
| (8) | Overfeed ratio | 7% |
| (9) | Heater 10 | Plate heater<br>Temperature 200° C.<br>Length 36 cm |
| (10) | Yarn tension (measured before an entrance of heater 10) | 0.06 g/denier |
| (11) | Appearance of an interlaced yarn | H (FIG. 10) = 0.7 mm (average value)<br>L (FIG. 10) = 6 mm (average value)<br>Interlace portion 62/m |
| (12) | Winding device | Ring twister<br>Spindle r.p.m. 7,000<br>Tension 0.16 g/de. |
| (13) | Wound up yarn | $l_1$ (FIG. 8) = 3 mm<br>$l_2$ (FIG. 8) = 5 mm<br>K value = 0.6<br>1st yield point of 1.5 g/de<br>Boil-off shrinkage 5.7%<br>Appearance Flat yarn like |
| (14) | Processability (Yarn breakage) | 0.6% per 1,000 spindles |

TABLE II

| (Weaving and Finishing Conditions) | | |
|---|---|---|
| (1) Yarn | Warp | 300 turns/meter(S) |
| | Weft | 2,000 turns/meter(S, Z) S and Z twisted yarn placed in alternate arrangement |
| (2) End spacing | | 29.6/cm |
| (3) Weft spacing | | 39.6/cm |
| (4) Relaxing of grey fabric | | 95° C. × 10 min. by a continuous scouring machine |
| (5) Pre-set | | 180° C. × 45 sec. |
| (6) Alkaline treatment | | Aqueous solution containing 35 g. of NaOH/l Reduction ratio 20.7% |
| (7) Dyeing machine | | LINI-ACE® (NIPPON DYEING MACHINE COMPANY); 130° C. × 45 min. |
| (8) Final set | | 160° C. × 45 sec. |
| (9) Final spacing | | End 67.5/cm Weft 40.0/cm |

TABLE III

| (Evaluation) | | |
|---|---|---|
| (1) | Dyeing speck (streak) | Non |
| (2) | Hand tactility after relaxed | Silk-like fullness softness |
| (3) | Drapeability | Quite similar to silk |
| (4) | Luster, hue | Very good |
| (5) | Creep test | 1.2 |

Evaluation of the fabric and Creep test are made according to functional test by trained observers and JIS 1080-1967, respectively. Additionally, creep test represents a ratio (%) of residual deformation after removal of stress to original length of fabric.

The above data shows that a silk-like fabric free from dyeing specks can be obtained by employment of the yarn of the invention since said yarn has a comparatively higher first (1st) yield point and a unitary coherency as a whole serving to improve weaving efficiency.

COMPARATIVE EXAMPLE 1

In an apparatus in FIG. 1, a jet 7, guide 8, 8', 8', buffer 9 and heater 10 are taken out, and, a roll of 4.0 cm diameter and heated to 180° C. is placed for instantaneous heat-treatment of a drawn yarn 6, in which said yarn is maintained under a tension of 0.001 g/de before the heated roll. Other conditions are same as in Example 1. The results are shown in Table-IV.

TABLE-IV

| Yarn processing speed (m/min) | | 10 | 30 | 50 | 100 | 500 |
|---|---|---|---|---|---|---|
| Processability | Yarn breakage (%) per 1,000 spindles | 0.1 | 0.4 | 0.5 | 1.5 | 5.3 |
| Textured yarn (Heat-treated yarn) | 1st yield point (g/de) | 0.5 | 0.8 | 1.3 | 1.6 | 1.8 |
| | Appearance | larger in loop and slack filament | larger in loop and large in slack filament | large in loop and slack filament | large in loop and small in slack filament | small in loop and slack filament |
| | Weaving efficiency | Extremely poor | Poor | Fair | Good | Good |
| | Dyeing speck (Streak) | Extremely remarkable | Remarkable | Fairly remarkable | Slightly remarkable | Slightly remarkable |
| Fabric | Hand, Tactility | Good | Fair | Fair | Poor | Extremely poor |
| | Draperbility | Good | Fair | Poor | Poor | Extremely poor |
| | Creep test (%) | 5.2 | 3.5 | 1.8 | 1.1 | 0.8 |

The above table shows that:

(i) Weaving efficiency is in inverse proportion to good hand, tactility ralized by loop and slack filament which is, in turn, formed due to partial uuckering of a yarn.

(ii) Textured yarn with less loops contributes to an improvement in weaving efficiency, but deteriorates fabric hand. Also yarn processability is bad.

For the purpose of improving the handling and running property of the above yarn, it is heat-treated on a plate heater of 4 cm long and heated to 210° C. at a 60 m/min. whereby loops and slack filaments on the yarn are shrunken in parallel to the yarn body.

Although this yarn of a flat yarn-like appearance shows a good weaving efficiency when woven into a fabric, a relazed fabric in subsequent scouring process lacks in silk-like fullness as well as scroop in addition to poor body.

COMPARATIVE EXAMPLE 2

Example 1 is carried out except that a jet in similar to TASLAN® jet in FIG. 8 of U.S. Pat. No. 2,783,609, and a drawn yarn 6 is introduced thereinto under an overfeed ratio of 15% and a fluid pressure of 5 $Kg/cm^2.G$.

The fluid treated yarn has crunodal loops and slack filaments in a ratio of 2:3. When said TASLAN® yarn is treated on the heater 10, for the shrinkage of loops, it has proturbences in the form of non-shrunken crunodal loops in a frequency of 10/cm and shows harsh hand.

EXAMPLES 2–9 AND COMPARATIVE EXAMPLES 3–7

In example 1, both pressure and overfeed ratio with respect to a jet 7 are varied to obtain various interlaced yarns different each other in the number of interlace portion. A relation between an interlace degree and K value, and fabric hand is shown in Table-V.

TABLE-V

| Run No. | Pressure ($Kg/cm^3$) | Over-feed (%) | Interlace Portion (Number/m) | K Value ($l_1/l_2$) | Fabric hand |
|---|---|---|---|---|---|
| 3* | 0 | 0 | 0 | 0 | Flat yarn-like |
| 4* | 0.3 | 0 | 6 | 0.05 | " |
| 5* | 0.5 | 1 | 14 | 0.12 | " |
| 2 | 1 | 1 | 21 | 0.20 | Silk-like fullness, very soft |
| 3 | 2 | 1 | 32 | 0.37 | Silk-like fullness, very soft |

TABLE-V-continued

| Run No. | Pressure (Kg/cm³) | Over-feed (%) | Interlace Portion (Number/m) | K Value ($l_1/l_2$) | Fabric hand |
|---|---|---|---|---|---|
| 4 | 3 | 1 | 51 | 0.52 | Silk-like fullness, very soft |
| 5 | 4 | 2 | 66 | 0.64 | Silk-like fullness, very soft |
| 6 | 3 | 3 | 80 | 0.72 | Silk-like fullness, very soft |
| 7 | 5 | 3 | 90 | 0.85 | Silk-like fullness, very soft |
| 8 | 4 | 5 | 100 | 0.96 | Silk-like fullness, very soft |
| 9 | 5 | 6 | 130 | 0.98 | Silk-like fullness, very soft |
| 6* | 5 | 10 | 140 | 1.15 | Similar to a false-twist crimped yarn |
| 7* | 5 | 13 | 150 | 1.22 | Similar to a false-twist crimped yarn |

Mark [*] means comparative examples

As will be clear from the Table, a bulkable yarn of the invention must meet two requirements at the same time for obtaining silk-like effects, namely interlace portions of at least 20/m and K value of at most 1.0.

EXAMPLE 10

Using an apparatus in FIG. 11, bulkable filamentary yarns are obtained under conditions in Table-VI and thereafter, said yarns are woven into a fabric of an appearance of a place crepe under weaving conditions in Table-II in Example 1. Further, the fabric obtained is dyed with use of DIANIX YELLOW GR-E (C.I. DISPERSE YELLOW 60) as a dyestuff. The result of evaluation of the dyed fabric is shown in Table-VII.

TABLE-VI (Conditions for preparing bulkable filamentary yarns)

| | | |
|---|---|---|
| (1) | Undrawn yarn 1 | Polyethylene terephthalate filaments with trilobal cross section, 143 de/36 fil. |
| (2) | Peripheral speed of feed roll 4 | 271 m/min. |
| (3) | Peripheral speed of larger diameter portion 18 of stepped roll 17 | 800 m/min. |
| (4) | Draw ratio | 2.95 |
| (5) | Boil-off shrinkage of drawn yarn 6 | 10% |
| (6) | Peripheral speed of smaller diameter portion 18 of stepped roll 17 | 784 m/min. |
| (7) | Jet 7 | Example 1<br>Pressure 1.5 Kg/cm². G |
| (8) | Yarn overfeed ratio | 2% |
| (9) | Heater 16 | Slit-heater of non-contact type heated to 200° C. therein.<br>Length 30 cm |
| (10) | Yarn tension between guide 8' and entrance of heater 16 | 0.11 g/de |
| (11) | Winding device 12 | Ring twister<br>Spindle r.p.m. 10,000<br>Winding tension 0.4 g/de |

TABLE-VI-continued (Conditions for preparing bulkable filamentary yarns)

Figure 13:
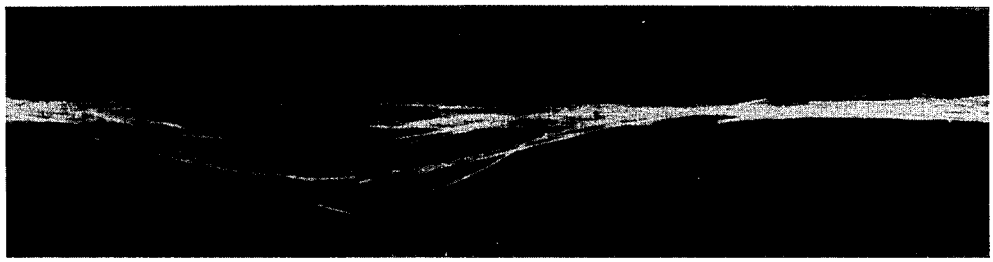
FIG. 13 is a photographic representation (×60) of the interlaced filamentary yarn with arc-like loops produced by the process of Example 10.
Figure 14:
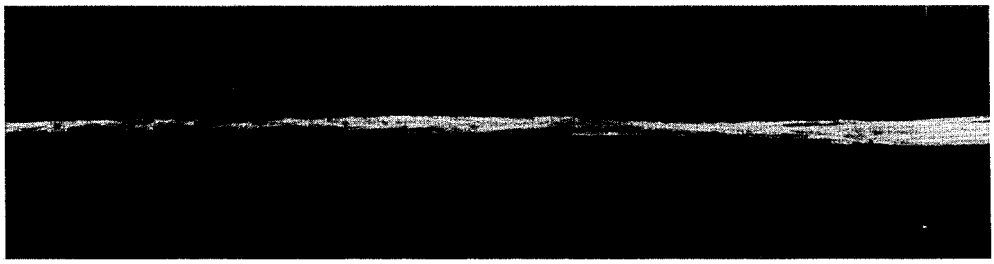
FIG. 14 is a photographic representation (×60) of the bulkable filamentary yarn produced by the process of Example 10.

| | | |
|---|---|---|
| (12) | Appearance of an interlaced yarn (FIG. 13) | H (FIG. 10) = 1.1 mm (Average value)<br>L (FIG. 10) = 13 mm (Average value)<br>Number of an interlace portion 62/m |
| (13) | Yarn breakage during texturing | 0.2% |
| (14) | Wound up yarn | Shown in FIG. 14<br>$l_1$ (FIG. 8) = 5 mm<br>$l_2$ (FIG. 8) = 11 mm<br>Flat yarn appearance<br>1st yield point 2.6 g/de<br>Boil-off shrinkage 8.0% |

TABLE-VII

| | | |
|---|---|---|
| (1) | Weaving efficiency | Good |
| (2) | Fabric, Dyeing speck | None |
| | Hand, Tactility | Very soft<br>Highly full as silk |
| | Draperbility | Good |
| | Luster, hue | Excellent |
| | Creep test | 0.2% |

Figure 15:
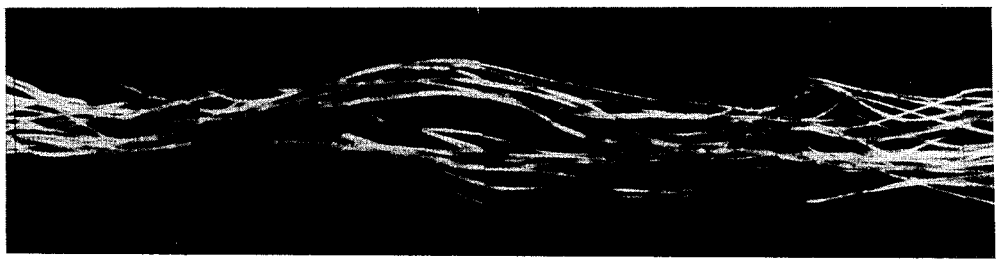
FIG. 15 is a photographic representation (×60) of silk-like yarn produced by the process of Example 10.
Figure 16:
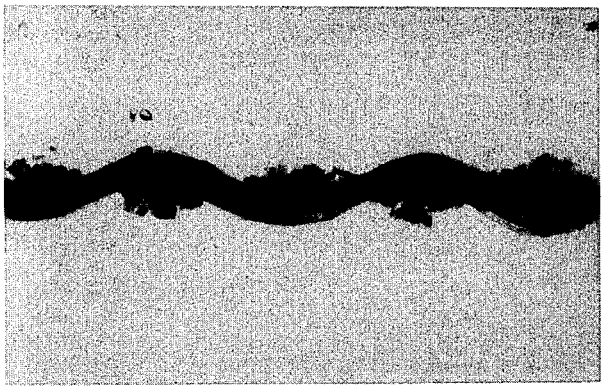
FIG. 16 is a photographic representation (×40) of a cross section along the warp direction, after boil-off and heat-setting, of the silk-like fabric produced by the process of Example 10.

It is recognized that the fabric obtained in this example shows more silk-like appeal compared with those obtained in Examples 1–9. In FIG. 15 is, shown one of the ends taken apart from the above fabric. Also shown in FIG. 16 is a cross section of the fabric along the warp direction. When compared with that of silk fabric in FIG. 17, there is not a bit of difference between them.

Figure 17:
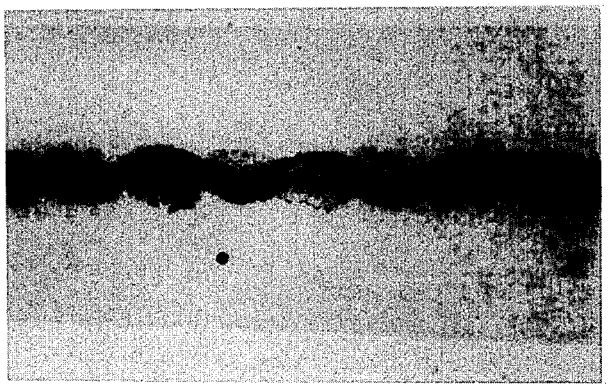
FIG. 17 is a photographic representation (×40) of a cross section along the warp length of silk fabric.
Figure 18:
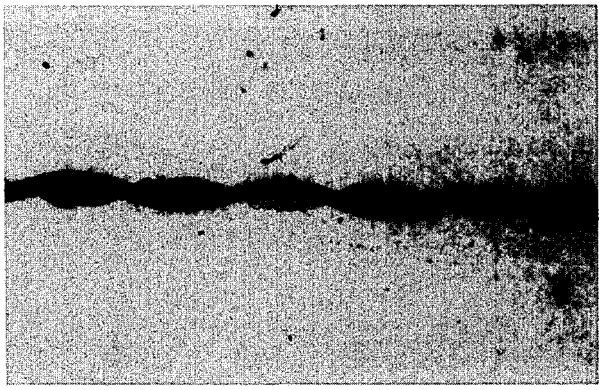
FIG. 18 is a photographic representation (×40) of a cross section along the warp direction of a conventional flat yarn fabric.

On the contrary, a cross section of a fabric made up of flat yarns only is shown in FIG. 18, from which one can easily understand that it has compact, flat section quite different from that of FIG. 16 or FIG. 17.

EXAMPLE 11

Using an apparatus shown in FIG. 12 under a texturing conditions in Table-VIII, and bulkable yarns obtained are woven into a fabric having an appearance of palace crepe and dyed as in Example 1. Evaluation of the finished fabric is shown in Table-IX.

TABLE-VIII (Conditions for preparing bulkable filamentary yarns)

| | | |
|---|---|---|
| (1) | Undrawn yarn 1 | Polyethylene terephthalate filaments with trilobal cross section, 143 de/36 fil. |
| (2) | Peripheral speed of of feed roll 4 | 271 m/min. |
| (3) | Peripheral speed of larger diameter portion 18 of stepped roll 17 | 800 m/min. |
| (4) | Draw ratio | 2.95 |
| (5) | Boil-off shrinkage of drawn yarn 6 | 15% |
| (6) | Peripheral speed of smaller diameter portion 18 of stepped roll 17 | 784 m/min. |
| (7) | Jet 7 | Example 1<br>pressure 2.0 Kg/cm². G |
| (8) | Yarn overfeed ratio | 2% |
| (9) | Heater 16 | Slit-heater of non-contact type heated to 180° C. therein.<br>Length 30 cm |
| (10) | Yarn tension between guide 8' and entrance of heater 16 | 0.07 g/de |

TABLE-VIII-continued

| (Conditions for preparing bulkable filamentary yarns) | | |
|---|---|---|
| (11) | Winding device 12 | Ring twister<br>Spindle r.p.m. 10,000<br>Winding tension 0.4 g/de |
| (12) | Appearance of interlaced yarn | H (FIG. 10) = 0.9 mm (Average value)<br>L (FIG. 10) = 11 mm (Average value)<br>Number of an interlace portion 60/m |
| (13) | Yarn breakage during texturing | 0.2%/1000 spindles |
| (14) | Wound up yarn | Flat yarn appearance<br>$l_1$ (FIG. 8) = 5 mm<br>$l_2$ (FIG. 8) = 9 mm<br>1st yield point 2.6 g/de<br>Boil-off shrinkage 11% |
| when the above yarn is heat-relaxed at 195° C., dry heat for 5 minutes in the form of hank, it developes its latent bulk in its bulkable portion as follows:<br>(i) $l_B$ in FIG. 9 13 mm<br>(ii) M.L.D.F. defined before 13.5%<br>(iii) Bulk 17.5 $cm^3/g$<br>(iv) Number of filaments having 3–12% of length difference 11 (about 30 in percentage of all the number of constituent filaments). | | |

TABLE-IX

| | | |
|---|---|---|
| (1) | Weaving efficiency | Good |
| (2) | Fabric, Dyeing speck | None |
| | Hand, Tactility | Very soft<br>Highly full (silk-like) |
| | Drapeability | Good (silk-like) |
| | Luster, hue | Excellent |
| | Creep test | 0.3% |

It is recognized that the fabric obtained in this example shows the same level of silk-like appeal as obtained in example 10.

EXAMPLE 12

Example 11 is carried out in the same manner except that polyester flat yarn (50 de/24 fil.) twisted to 2,000 turns/meter is used as the weft wherein S twist and Z twist are placed alternately and relaxing of a grey fabric is carried out by use of a rotary washer at 95° C. for 25 minutes.

The finished fabric is quite similar to silk in fullness as well as softness and also free from any dyeing speck.

EXAMPLE 13

Example 11 is carried out in the same manner except that a false-twist crimped polyester yarn (50 de/24 fil.) is used as the weft wherein S twist-set crimped yarn and Z twist-set crimped yarn in the false twist crimping machine are place alternately and relaxing is carried out by use of a rotary washer at 95° C. for 25 minutes.

When producing said crimped yarn, a flat yarn is first pre-twisted to 800 turns/meter using a ring twister, then pre-twisted yarn is false-twisted in a direction same as a direction of the pre-twist.

For comparision, a conventional "de Chine" is prepared by replacing the bulkable filamentary yarns in the above with flat yarns of same denier and same twist.

The above two samples are evaluated by trained observers who conclude that the fabric according to the invention is superior in fullness, drapeability and softness to the conventional fabric for comparison.

What we claim is:

1. A bulkable filamentary yarn in which constituent filaments of substantially straight form are assembled with each other, said yarn having interlaced portions of at least 20 per meter along the yarn length wherein a filamentary group between each adjacent pair of interlaced portions exhibits mixed, differential boil-off shrinkage characteristics both among the filaments and within each of the filaments, and K value, as defined by the following formula, of the yarn being no more than 1.0

$$K = l_1/l_2$$

wherein $l_1$ is the length of an interlaced portion and $l_2$ is the length of a non-interlace portion hereinbefore defined.

2. A bulkable filamentary yarn according to claim 1 in which the yarn is composed essentially of polyethylene terephthalate.

3. A bulkable filamentary yarn according to claim 1 in which the yarn has interlaced portions of at most 130 per meter of the yarn length.

4. A bulkable filamentary yarn according to claim 1 in which the yarn has a total denier of no more than 75, and single filament (monofilament) denier no more than 1.7.

5. A bulkable filamentary yarn according to any one of the preceding claims in which the yarn has a boil-off shrinkage of no more than 13% and exhibits, upon heat-relaxing at 195° C., dry heat for a time of 5 minutes, full-hand portions meeting the following requirements:

(a) the maximum filament-amplitude is no more than 25 mm (b) the maximum length-difference of the filaments is no more than 15%, and (c) filaments having the length-difference of 3% to 12% occupies at least 15% of the total number of the constituent filaments.

6. A bulky filamentary yarn according to claim 5 in which the yarn, after heat relaxation, exhibits bulk of 14 $cm^3/g$ to 20 $cm^3/g$.

* * * * *